US006855284B2

(12) United States Patent
Lanni et al.

(10) Patent No.: US 6,855,284 B2
(45) Date of Patent: Feb. 15, 2005

(54) PROCESS FOR BENDING A WORKPIECE

(75) Inventors: Arthur L. Lanni, Cary, NC (US); Joseph Oravsky, Clayton, NC (US); Tri D. Vu, Apex, NC (US)

(73) Assignee: ABB Technology AG, Zurich (CH)

( * ) Notice: Subject to any disclaimer, the term of this patent is extended or adjusted under 35 U.S.C. 154(b) by 290 days.

(21) Appl. No.: 10/135,287

(22) Filed: Apr. 30, 2002

(65) Prior Publication Data

US 2003/0201574 A1 Oct. 30, 2003

(51) Int. Cl.[7] ..... B29C 53/04; B29C 53/36; B29C 65/48; B29C 65/70

(52) U.S. Cl. ..... 264/295; 264/296; 264/339; 156/196; 156/221; 156/222; 156/227; 156/443

(58) Field of Search ..... 264/295, 296, 264/339; 156/196, 221, 222, 227, 443; 73/310, 319, 320, 321

(56) References Cited

U.S. PATENT DOCUMENTS

| | | | | | |
|---|---|---|---|---|---|
| 1,872,482 | A | * | 8/1932 | Messing | 264/339 |
| 2,283,012 | A | | 5/1942 | Nightingale | 153/16 |
| 2,420,119 | A | * | 5/1947 | Boehm et al. | 264/339 |
| 2,634,321 | A | * | 4/1953 | Larkin | 336/215 |
| 3,096,805 | A | | 7/1963 | Biggs et al. | 153/2 |
| 3,220,291 | A | * | 11/1965 | Olsen et al. | 83/236 |
| 3,251,208 | A | | 5/1966 | Mittermaier | 72/16 |
| 3,733,872 | A | * | 5/1973 | Gregoire | 72/213 |
| 3,775,721 | A | * | 11/1973 | Koh | 336/160 |
| 4,601,689 | A | * | 7/1986 | Finkle et al. | 493/251 |
| 4,713,957 | A | | 12/1987 | Eder et al. | 72/319 |
| 4,744,846 | A | * | 5/1988 | Pflug et al. | 156/212 |
| 4,756,863 | A | * | 7/1988 | Petershofer | 264/322 |
| 4,847,583 | A | * | 7/1989 | Bernard | 336/84 C |
| 4,892,773 | A | * | 1/1990 | Chenoweth et al. | 428/121 |
| 5,161,401 | A | | 11/1992 | Lisec | 72/307 |
| 5,259,231 | A | | 11/1993 | Kutschker | 72/319 |
| 5,261,152 | A | | 11/1993 | Simozaki et al. | 29/609 |
| 5,354,522 | A | * | 10/1994 | Baartman | 264/479 |
| 5,474,437 | A | | 12/1995 | Kuroyone | 425/150 |
| 5,549,862 | A | * | 8/1996 | Vail | 264/238 |
| 5,842,369 | A | | 12/1998 | Kutschker | 72/319 |
| 6,473,961 | B1 | * | 11/2002 | Segal et al. | 29/609 |
| 2003/0121303 | A1 | * | 7/2003 | Lanni et al. | 72/31.1 |

FOREIGN PATENT DOCUMENTS

| | | | | |
|---|---|---|---|---|
| JP | 63-204707 A | * | 8/1988 | H01F/41/02 |
| JP | 403023017 A | | 1/1991 | |

OTHER PUBLICATIONS

JPO English Abstract of JP–63–204707 A, 1988, Japanese Patent Office.*

* cited by examiner

*Primary Examiner*—Michael P. Colaianni
*Assistant Examiner*—Michael I. Poe
(74) *Attorney, Agent, or Firm*—Woodcock Washburn LLP

(57) ABSTRACT

A presently-preferred process for bending a workpiece includes placing a first portion of the workpiece on a substantially flat surface so that a second portion of the workpiece overhangs an edge of the substantially flat surface, and securing the first portion of the workpiece on the substantially flat surface by clamping the workpiece between the substantially flat surface and a substantially v-shaped end portion of a male die. The presently-preferred process also includes causing the second portion of the workpiece to pivot around a tip of the substantially v-shaped end portion by rotating a bending die around the tip while the bending die contacts the second portion of the workpiece.

24 Claims, 5 Drawing Sheets

PROCESS FOR BENDING A WORKPIECE

FIELD OF THE INVENTION

The present invention relates generally to bending workpieces formed from rigid or semi-rigid materials. More particularly, the present invention relates to a process for bending laminae used to form windings for a power-transformer cores.

BACKGROUND OF THE INVENTION

Windings for power-transformer cores have traditionally been formed by winding a thin, flat strip of magnetic material into a circular pattern, and then pressing the wound material into a rectangular pattern. The rectangularly-shaped material is then annealed to relieve the internal stresses induced by the pressing operation (high internal stresses within the winding can induce operating losses, and are therefore undesirable).

Alternatively, a wound core can be formed by bending and then stacking a plurality of laminae formed from a magnetic material. More particularly, substantially flat laminae of various lengths are each formed into a U-shaped pattern by bending each laminae at two or more locations thereon. The U-shaped laminae are then stacked, i.e., superposed, and bound to each other in order of decreasing size. In other words, the laminae are arranged one-inside-the-other. This arrangement forms a U-shaped laminate. A second U-shaped laminate of complementary shape and size is formed in a similar manner, inverted, and fixed to the first U-shaped laminate to form a rectangular winding.

The laminae are typically bent by using a die set 100 comprising a male die 112 and a female die 114, as shown in FIG. 5. The male die 112 comprises a v-shaped end portion 112*a*. The female die 114 defines a v-shaped groove 115 adapted to receive the end portion 112*a*. A lamina 116 is placed between the end portion 112*a* and the groove 115. More particularly, a desired bending location on a lamina 116 is aligned with the end portion 112*a* and the groove 115. The male die 112 is subsequently driven downward, toward the female die 114. The resulting contact between the end portion 112*a* and the lamina 116 drives the desired bending location on the lamina 116 downward, into the groove 115, and thereby places a bend in the lamina 116.

Forming a transformer-core winding by bending and stacking a plurality the laminae offers advantages in relation to forming the winding from a continuous strip of material. For example, the operating losses associated with the laminated winding, without annealing, are comparable to those associated with the continuously-wound, annealed winding (provided the plastic deformation at the bending locations on each lamina 116 is limited to approximately five times the thickness of the lamina 116). Eliminating the need for the annealing process substantially reduces the time and expense needed to manufacture a transformer-core winding.

The bending process described above, however, presents certain disadvantages. For example, the configuration of the die set 100 causes the ends of the lamina 116 to deflect upwardly as the lamina 116 is bent. More specifically, the downward movement of the lamina 116 at the bending location, in conjunction with the resistance offered by the female die 114, causes the ends of the lamina 116 to be displaced upwardly, as shown in FIG. 5. The lamina 116 is also drawn inward, toward the dies 112, 114. This displacement decreases the precision with which the 116 can be bent. In particular, the noted displacement of the lamina 116 makes it more difficult to maintain the initial alignment between the male die 112 and the desired bending location on the lamina 116 as the lamina 116 is bent.

The imprecision introduced by the displacement of the laminae 116 during the bending process increases the manufacturing tolerances of the laminated winding (and a transformer core formed therefrom). The operating losses of a transformer core generally increase with increasing manufacturing tolerances. Hence, higher manufacturing tolerances are generally undesirable. Furthermore, the above-described bending process is unsuitable for placing multiple bends in the lamina 116 due to the noted movement of the lamina 116. (The ability to place multiple bends in the lamina 116 on a simultaneous basis can substantially reduce the time needed to manufacture a laminated winding, and is therefore desirable.)

An ongoing need therefore exists for a process for bending laminae for a transformer that locates the bend location with relatively high degree of precision, and that is suitable for forming multiple bends on a simultaneous basis.

SUMMARY OF THE INVENTION

A presently-preferred process for bending a workpiece comprises placing a first portion of the workpiece on a substantially flat surface so that a second portion of the workpiece overhangs an edge of the substantially flat surface, and securing the first portion of the workpiece on the substantially flat surface by clamping the workpiece between the substantially flat surface and a substantially v-shaped end portion of a male die. The presently-preferred process also comprises causing the second portion of the workpiece to pivot around a tip of the substantially v-shaped end portion by rotating a bending die around the tip while the bending die contacts the second portion of the workpiece.

Another presently-preferred process for bending a workpiece comprises placing a first portion of the workpiece in contact with a substantially flat surface so that a second portion of the workpiece overhangs an edge of the substantially flat surface, and securing the workpiece by urging a tip of a v-shaped portion of a male die onto the workpiece so that the workpiece is substantially restrained from linear movement in relation to the substantially flat surface. The presently-preferred process also comprises urging the second portion of the workpiece toward the male die.

A presently-preferred process for bending a workpiece at a desired bending location comprises placing a portion of the workpiece on a substantially flat surface of a work table, substantially aligning the desired bending location with an edge of the substantially flat surface, and clamping the workpiece between the substantially flat surface and a tip of a substantially v-shaped end portion of a male die substantially aligned with the edge of the substantially flat surface. The presently-preferred process also comprises placing a substantially cylindrical bending die in contact with a location on the workpiece proximate the edge of the substantially flat surface, and rotating the bending die substantially around the tip while a point of contact between the workpiece and the bending die remains substantially constant.

A presently-preferred process for bending a workpiece at two locations thereon on a simultaneous basis comprises placing a first portion of the workpiece on at least one substantially flat surface so that a second portion of the workpiece overhangs a first edge of the at least one substantially flat surface and a third portion of the workpiece overhangs a second edge of the at least one substantially flat surface. The presently-preferred process also comprises securing the first portion of the workpiece on the at least one substantially flat surface by clamping the workpiece between the at least one substantially flat surface and a substantially v-shaped end portion of a first male die, and between the at least one substantially flat surface and a substantially v-shaped end portion of a second male die.

The presently-preferred process for bending a workpiece at two locations thereon on a simultaneous basis further comprises causing the second portion of the workpiece to pivot about a tip of the substantially v-shaped end portion of the first male die by rotating a first bending die around the tip of the substantially v-shaped end portion of the first male die while the first bending die contacts the second portion of the workpiece, and simultaneously causing the third portion of the workpiece to pivot about a tip of the substantially v-shaped end portion of the second male die by rotating a second bending die around the tip of the substantially v-shaped end portion of the second male die while the second bending die contacts the third portion of the workpiece.

A presently-preferred process for process for forming a transformer-core winding comprises placing a first portion of a lamina formed from magnetic material on a substantially flat surface so that a second portion of the lamina overhangs an edge of the substantially flat surface, and securing the first portion of the lamina on the substantially flat surface by clamping the lamina between the substantially flat surface and a substantially v-shaped end portion of a male die. The presently-preferred process also comprises causing the second portion of the lamina to pivot around a tip of the substantially v-shaped end portion by rotating a bending die around the tip while the bending die contacts the second portion of the lamina, removing the lamina from the substantially flat surface, and stacking the lamina with other lamina having a substantially similar shape.

A presently-preferred apparatus for bending a workpiece comprises a work table having a substantially flat surface adapted to receive the workpiece, and a male die having a substantially v-shaped end portion adapted to exert a contact pressure on the workpiece to thereby secure the workpiece to the work table. The presently-preferred apparatus further comprises a bending die adapted to rotate around a tip of the substantially v-shaped end portion while the bending die contacts the workpiece thereby causing a portion of the workpiece to pivot around the tip.

BRIEF DESCRIPTION OF THE DRAWINGS

The foregoing summary, as well as the following detailed description of a presently-preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

Figure 1:
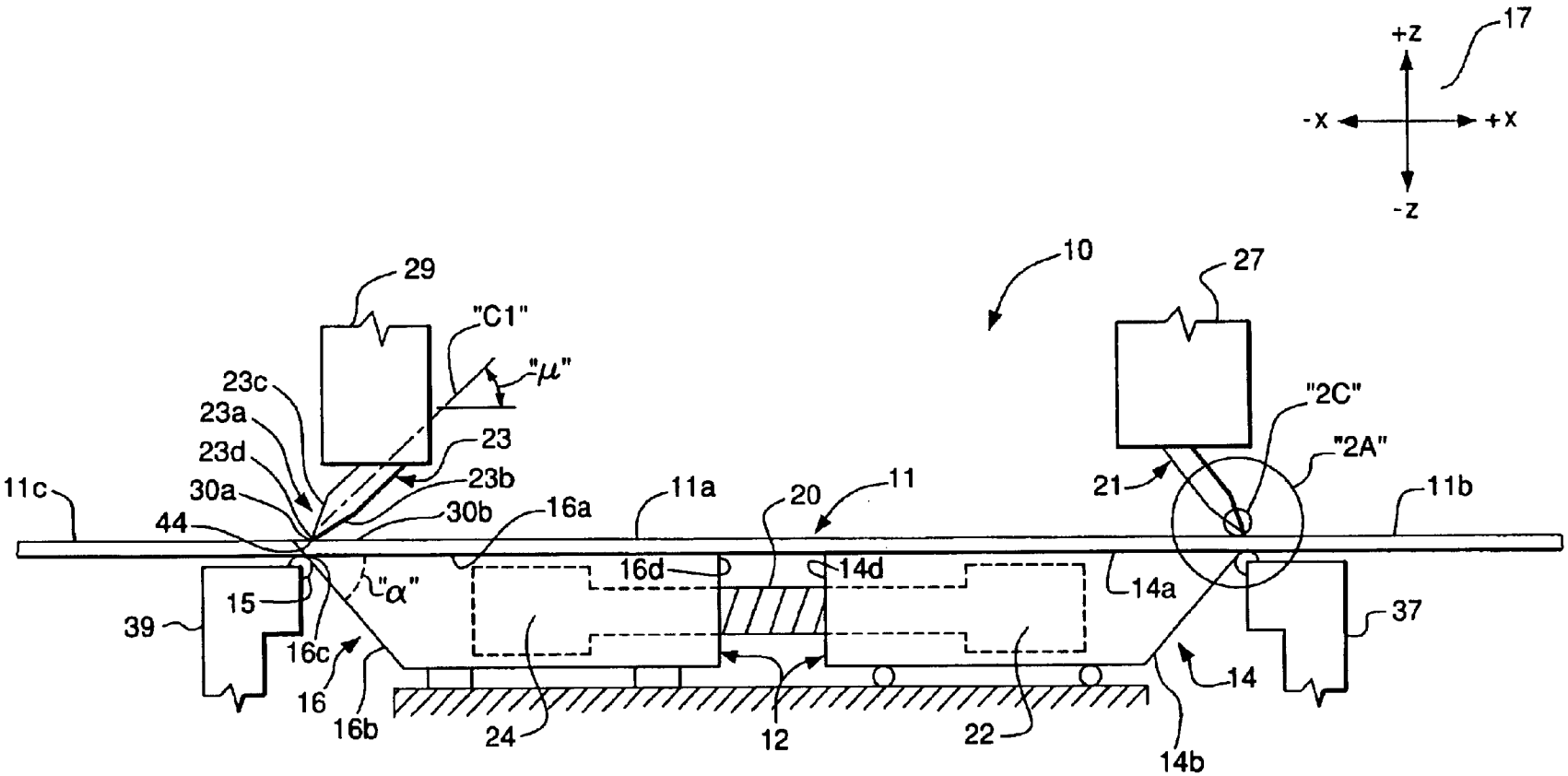
FIG. 1 is a diagrammatic side view of a bending apparatus suitable for performing the presently preferred process for bending a workpiece, and a lamina for a transformer-core winding secured in place thereon.
Figure 2A:
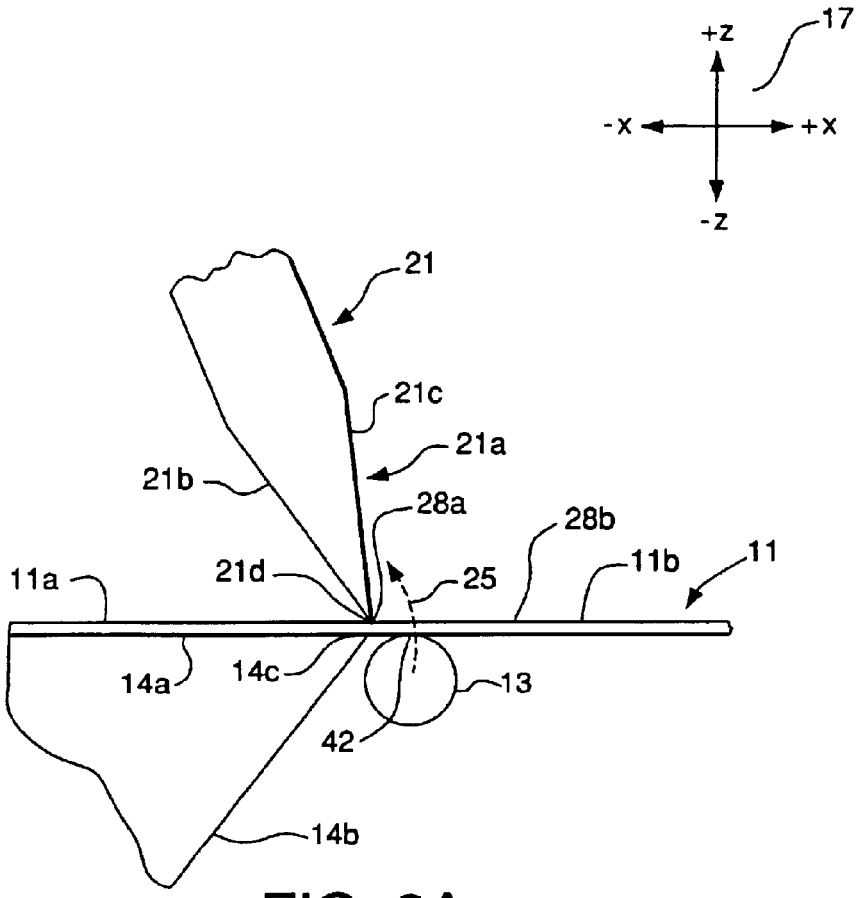
FIG. 2A is a magnified view of the area designated "2A" in FIG. 1, depicting the lamina shown in FIG. 1 being bent in accordance with the presently preferred process.
Figure 2B:
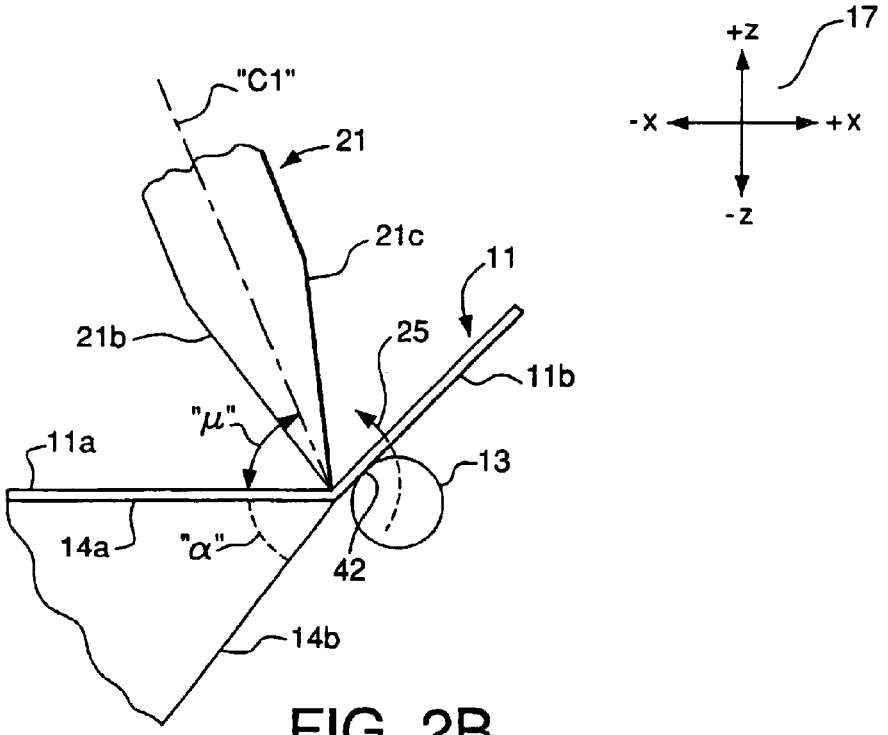
FIG. 2B is a magnified view of the area designated "2A" in FIG. 1, depicting the lamina shown in FIGS. 1 and 2 as the lamina is bent in accordance with the presently preferred process.
Figure 2C:
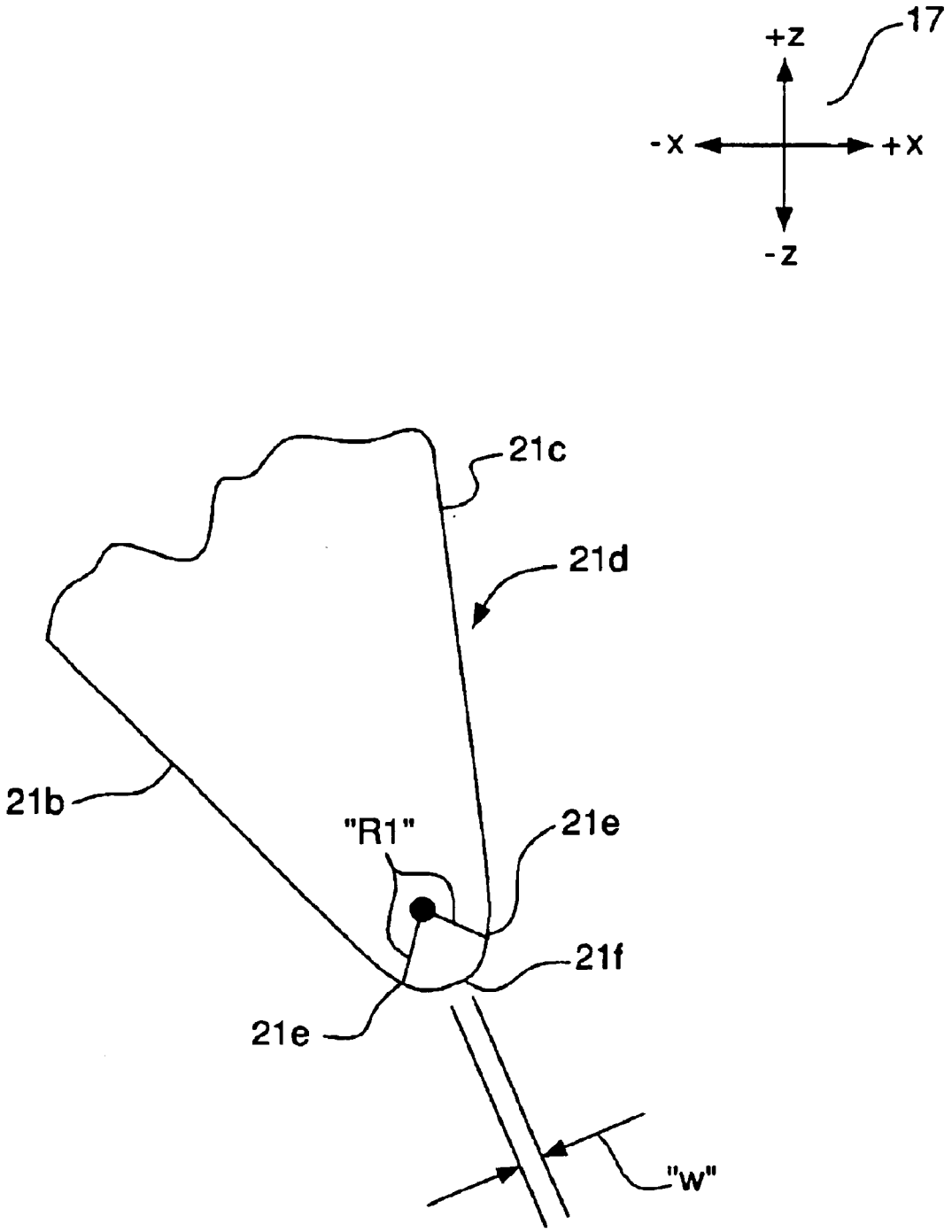
FIG. 2C is a magnified view of the area designated "2C" in FIG. 1.

A presently-preferred process for bending a workpiece is described herein in connection with a bending apparatus 10 depicted in FIGS. 1 through 2B. The bending apparatus 10 is described in detail for exemplary purposes only, as the presently-preferred process can be performed using other suitable types of apparatus. The bending apparatus is adapted to bend a lamina 11 at one or more locations thereon. The lamina 11 comprises a relatively thin, narrow strip of magnetic material such as textured silicon steel or an amorphous alloy, and is used to form a winding for a power-transformer core. This particular type of workpiece is described for exemplary purposes only, as the presently-preferred process can be used to bend virtually any type of workpiece formed from a relatively thin sheet of rigid or semi-rigid material. (It should be noted that thickness of the lamina 11 is exaggerated in the figures, for clarity.)

The bending apparatus 10 comprises a work table 12 having a first portion 14 and a second portion 16 (see FIG. 1). The first portion 14 has a substantially flat upper surface 14*a* and an adjoining, substantially flat outwardly-facing surface 14*b*. The junction of the surfaces 14*a*, 14*b* forms an edge 14*c*.

The outwardly-facing surface 14*b* is positioned at an acute angle with respect to the upper surface 14*a* (this angle is denoted by the symbol "$\alpha$" in FIG. 1.) The value of a is approximately 45 degrees in the exemplary bending apparatus 10. (A particular value for a is specified for exemplary purposes only, as the optimal value for a is application dependent.) The first portion 14 of the work table 12 also includes a substantially flat, inwardly-facing surface 14*d* that adjoins the upper surface 14*a* at a substantially right angle.

The second portion 16 of the work table 12 comprises has a substantially flat upper surface 16*a* and an adjoining, substantially flat inwardly-facing surface 16*b*. The junction of the surfaces 16*a*, 16*b* forms an edge 16*c*. The outwardly-facing surface 16*b* is positioned at the angle a with respect to the upper surface 16*a* (see FIG. 2B). The second portion 16 also includes an inwardly-facing surface 16*d* that adjoins the upper surface 16*a* at a substantially right angle. The second portion 16 is symmetrically disposed with respect to the first portion 14, and is otherwise substantially identical to the first portion 14. In other words, the upper surfaces 14*a*, 16*a* are substantially co-planar, and the inwardly-facing surface 14*d* opposes the inwardly-facing surface 16*d*.

The first and second portions 14, 16 of the work table 12 are movable in relation to each other. The first and second portions 14, 16 are coupled by way of a rotatable drive screw 20 (see FIG. 1). A motor 22 located within the first portion 16 is adapted to rotate the drive screw 20. A threaded coupling 24 is fixedly coupled to the second portion 16, and is adapted to rotatably receive the drive screw 20. The coupling 24 transforms the rotational movement of the drive screw 20 into linear (x-direction) movement of the second portion 16, thereby driving the second portion 16 toward or away from the first portion 14. The significance of this feature is explained below. (The "x" direction is denoted by the coordinate system 17 included in the figures.)

The bending apparatus 10 further comprises a first and a substantially identical second bending die 13, 15. The bending dies 13, 15 each have a substantially cylindrical shape, and are coupled respectively to hydraulically-actuated rams 37, 39 (see FIG. 1). The ram 37 is adapted to move the bending die 13 along a path denoted by the arrow 25 in FIGS. 2A and 2B (the ram 37 is not depicted in FIGS. 2A and 2B, for clarity.) The ram 39 is adapted to move the bending die 15 along a substantially identical path in relation to the second portion 16 of the work table 12 and the lamina 11. Further details concerning movement of the bending dies 13, 14 are presented below.

The bending apparatus 10 further comprises a first and a substantially identical second male die 21,23. The male die 21 has a substantially v-shaped end 21*a*. The end portion 21*a* is defined by first and second side surfaces 21*b*, 21*c* and an adjoining tip portion 21*d* (see FIG. 2A–2C). The tip portion 21*d* preferably includes rounded surface portion 21*e* and a substantially flat surface 21*f* adjoining the rounded surface portion 21*e*. The rounded surface portions 21*e* each preferably have a radius of curvature "R1" within a range of approximately 0.02 mm to approximately 0.06 mm, and the substantially flat surface portion 21*f* preferably has a width "W" within a range of approximately 0.005 mm to approximately 0.020 mm. The significance of these features is explained below.

The male die 23 is substantially identical to the male die 21. The preceding details regarding the male die 21 therefore apply equally to the male die 23.

The male dies 21,23 are mounted respectively on hydraulically-actuated rams 27, 29, and are angled in relation to the upper surfaces 14*a*, 16*a* of the work table 12. More particularly, a centerline "C1" of each male die 21, 23 is disposed at an acute angle "$\mu$" in relation upper surfaces 14*a*, 16*a* (see FIGS. 1, 2B). (The optimal value for $\mu$ is application-dependent; a particular value for this parameter therefore is not specified herein.)

The tip 21*d* of the male die 21 is substantially vertically aligned with the edge 14*c* of the work table 12. The tip 23*d* of the male die 23 is likewise substantially vertically aligned with the edge 16*c* of the work table 12. (Directional terms such as "vertical" are used throughout the specification and claims with reference to the component orientations depicted in FIG. 1; these terms are used for illustrative purposes only and, unless expressly stated otherwise, are not intended to limit the scope of the appended claims.)

The rams 27, 29 are adapted to move the respective male dies 21, 23 vertically, between an upper position (not shown) and a lower position (FIG. 1). The rams 27, 29 are also adapted to move laterally, i.e., in the "x" direction. Moreover, the rams 27, 29 are mechanically coupled to the work table 12 in a manner that causes the rams 27, 29 to translate laterally in conjunction with the first and second portions 14, 16 of the work table 12. In other words, the rams 27, 29 are linked to the work table 12 in a manner that causes the tips 21*d*, 23*b* of the male dies 21, 23 to remain substantially vertically aligned with the respective edges 14*c*, 16*c* as the relative positions of the first and second portions 14, 16 are adjusted.

Further details concerning the bending apparatus 10 are not necessary to an understanding of the invention, and therefore are not included herein.

Details relating to the presently-preferred process are as follows. The presently-preferred process is described herein in conjunction with the bending apparatus 10 and the lamina 11, as noted previously. Moreover, the presently preferred process as described herein is used to bend the lamina 11 into a substantially U-shaped configuration by forming a first and a second pair of closely-spaced, 45-degree bends therein (the lamina 11 is depicted in its final configuration in FIG. 3).

The bending locations on the lamina 11 are denoted by the alphanumeric symbols 28*a*, 28*b*, 30*a*, and 30*b* in the figures. This particular arrangement of bends is described for exemplary purposes only, as the presently-preferred process can be used to bend a particular workpiece at more or less than four locations thereon (including one single location). Furthermore, the presently-preferred process can be used to form bends greater or less than 45 degrees.

The work table 12 is initially adjusted so that the overall length, i.e., the x-direction spacing between the edges 14*c*, 16*c*, is substantially equal to the spacing between the outermost bending locations on the lamina 11, i.e., the bending locations 28*a*, 30*a*. The lamina 11 is placed on the work table 12 while the male dies 21, 23 are in the upper position, and the bending locations 28*a*, 30*a* are subsequently aligned with the respective edges 14*c*, 16*c* of the work table 12. (The spacing between the tips 21*d*, 23*d* of the male dies 21, 23 and the respective surfaces 14*a*, 16*a* is sufficient to permit the lamina 11 to be placed thereon when the male dies 21, 23 are in the upper position.)

The male dies 21, 23, as noted previously, are mechanically linked to the work table 12 so that the tips 21*d*, 23*d* of the male dies 21, 23 remain substantially vertically aligned with the respective edges 14*c*, 16*c* of the work table 12. Hence, aligning the bending locations 28*a*, 30*a* on the lamina 11 with the edges 14*c*, 16*c* also aligns the bending locations 28*a*, 30*a* with the respective tips 21*d*, 23*d* of the male dies 21, 23.

The male dies 21, 23 are subsequently moved to the lower position by the rams 27, 29. More particularly, the male dies 21, 23 are lowered until the tips 21*d*, 23*d* contact the respective bending locations 28*a*, 30*a* on the lamina 11. Sufficient downward force is exerted by the rams 27, 29 to secure the lamina 11 in place in relation to the work table 12.

The portion of the lamina 11 located inward of the bending locations 28*a*, 30*a* is fixed to the work table 12 by the clamping effect of the male dies 21, 23 (this portion of the lamina is hereinafter referred to as the "fixed portion 11*a*"). This arrangement restrains the lamina 11 from linear movement in relation to the work table 12. No additional support or restraint is placed on the portions of the lamina 11 located outward of the bending locations 28*a*, 30*a* (see, e.g., FIG. 1). The portions of the lamina 11 located outward of the bending locations 28*a*, 30*a* thus overhang the edges 14*c*, 16*c* of the work table 12 (these portions are hereafter referred to as the "overhanging portion 11*b*" and the "overhanging portion 11*c*").

The rams 37, 39 are simultaneously activated after the lamina 11 is securely positioned on the work table 12. The ram 37 causes the bending die 13 to translate along the path denoted by the arrow 25 in FIGS. 2A and 2B, as noted previously. The ram 39 causes the bending die 15 to translate along a substantially identical path in relation to the portion 16 of the work table 12 and the lamina 11, as also noted previously.

Each bending die 13, 15 is initially located in a lowermost, or starting, position proximate the respective edges 14*c*, 16*c*, and below the lamina 11, as shown in FIGS. 1 and 2A. The rams 37, 39 move the bending dies 13, 15 into contact with the lamina 11. The point of contact between the bending die 13 and the lamina 11 is denoted by the numeric symbol 42, and the point of contact between the bending die 15 and the lamina 11 is denoted by the numeric symbol 44 in the figures. The points of contact 42, 44 are located outward of, and proximate to, the respective bending locations 28*a*, 30*a*. In other words, the points of contact 42, 44 are located on the respective overhanging portions 11*b*, 11*c*, proximate the bending locations 28*a*, 30*a*.

The ram 37 moves the bending die 13 along a substantially curvilinear path, and causes the bending die 13 rotate about the tip 21*d* of the male die 21 (see FIG. 2B). This movement imparts a corresponding movement to the overhanging portion 11*b* of the lamina 11. In particular, the noted movement of the bending die 13 urges the overhanging portion 11*b* substantially upward. This motion, in conjunction with the restraining effect of the male die 21 and the work table 12, cause the overhanging portion 11*b* to pivot about the tip 21*d* of the male die 21. The fixed portion 11*a* of the lamina 11 is restrained from rotating or pivoting by the work table 12 and the male die 21. Hence, the pivoting motion of the overhanging portion 11*b* causes the bend lamina 11 to bend substantially at its pivot point, i.e., at the desired bending location 28*a* (which coincides with the location of the tip 21*d*).

The circular path of the bending die 13 causes the point of contact 42 to remain in substantially the same location in relation to the bending die 13 and the lamina 11 as the bending die 13 continues its rotation about the tip 21*d*. The continued movement of the bending die 13 progressively increases the bend imparted to the lamina 11 at the bending location 28*a*. The movement of the ram 37 is stopped when the bend reaches a predetermined value, i.e., when the angle between the overhanging portion 11*b* and the horizontal reaches approximately 45 degrees.

The ram 39 likewise moves the bending die 15 along a substantially curvilinear path, and causes the bending die 15 rotate about the tip 23*d* of the male die 23. This movement imparts a corresponding movement to the overhanging portion 11*c* of the lamina 11, and thereby bends the lamina 11 at the desired bending location 30*a* in the above-described manner.

The bending dies 13, 15 are returned to their respective starting (lower) positions and the male dies 21, 23 are returned to their upper positions after the desired bends have been imparted to the lamina 11 at the bending locations 28*a*, 30*a*. A second set of 45-degree bends is subsequently placed in the lamina 11 at the bending locations 28*b*, 30*b*, in the following manner.

The motor 22 of the work table 12 is activated to move the second portion 16 thereof closer to the first portion 14. More particularly, the second portion 16 is moved toward the first portion 14 until the spacing between the edges 14*c*, 16*c* is substantially equal to the spacing between the bending locations 28*b*, 30*b*. The bending locations 28*b*, 30*b* are subsequently aligned with the respective edges 14*c*, 16*c*. The male dies 21, 23 are then moved to their lower position, thereby securing the lamina 11 in position on the work table 12.

The rams 37, 39 are subsequently activated, causing the bending dies 13, 15 to translate in the manner described above in connection with the bending locations 28*a*, 30*a*. The movement of the bending dies 13, 15, in conjunction with the restraining effect of the work table 12 and the male dies 21, 23, bends the lamina 11 at the bending locations 28*b*, 30*b* in a manner substantially identical to that described above with respect to the bending locations 28*a*, 30*a*. The movement of the bending dies 13, 15 is stopped when a bend of approximately 45 degrees has been imparted the lamina 11 at the bending locations 28*b*, 30*b*. The bending dies 13, 15 are subsequently returned to their respective starting positions and the male dies 21, 23 are moved to their upper positions, thereby releasing the lamina 11.

Figure 3:
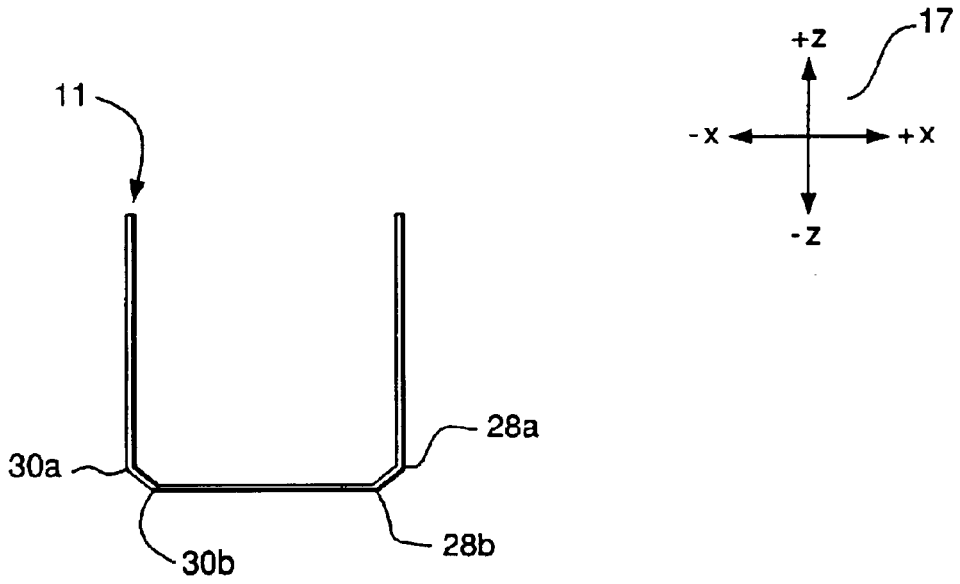
FIG. 3 is a side view of the lamina shown in FIGS. 1–2B after the lamina has been bent in accordance with the presently preferred process.
Figure 4:
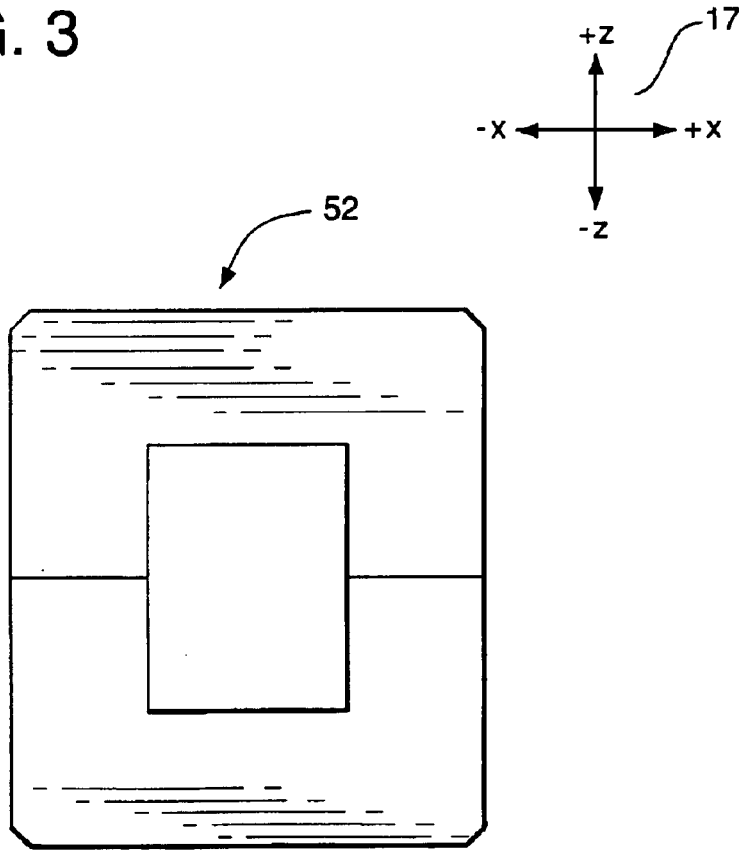
FIG. 4 is a side view of a winding for a power-transformer core formed from laminae that have been bent in accordance with the presently preferred process.
Figure 5:
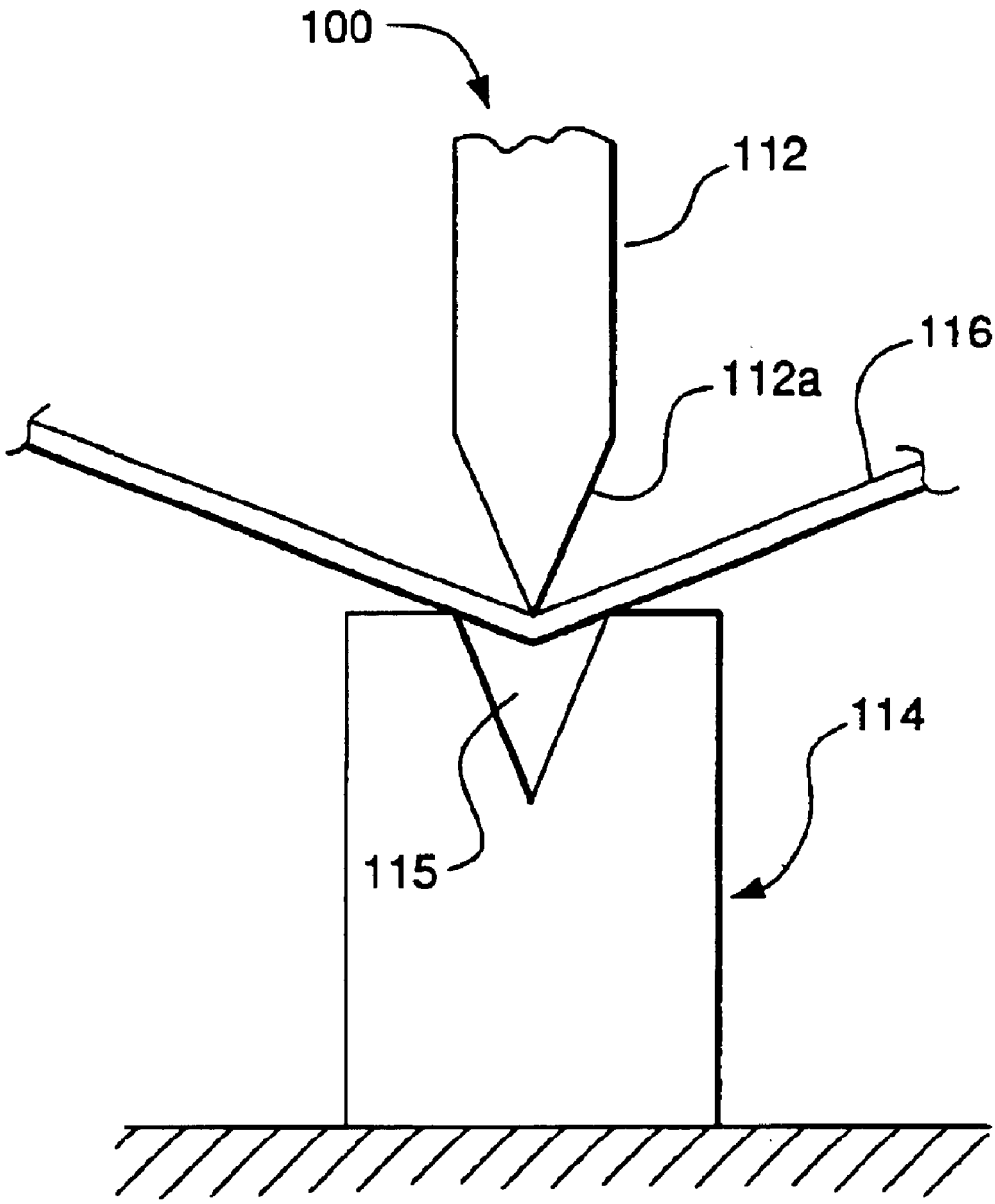
FIG. 5 PRIOR ART
FIG. 5 is a side view of a conventional male and female die being used to bend a workpiece in accordance with a conventional bending process.

The lamina 11 at this point is substantially U-shaped as a result of the pair of closely-spaced, 45-degree bends at the bending locations 28*a*, 28*b*, and another pair of closely-spaced, 45-degree bends at the bending locations 30*a*, 30*b* (see FIG. 3). The lamina 11 is thus ready to be stacked with other laminae of similar shape to form a laminate that, when joined with another laminate of complementary shape and dimensions, forms a substantially rectangular transformer-core winding 52, as depicted in FIG. 4.

The presently-preferred process provides substantial advantages in relation to bending processes that utilize a conventional male and female die. For example, securing the lamina 11 in place using the work table 12 and the male dies 21, 23 enhances the precision with which the lamina 11 can be bent. More specifically, clamping the lamina 11 between the male dies 21, 23 and the work table 12, and supporting the fixed portion 11*a* of the lamina 11 on the work table 12 causes the relative positions of the desired bending locations and the male dies 21, 23 to remain substantially constant during the bending process. In other words, the lamina 11 is not "drawn into" the male dies 21, 23 as in a bending process utilizing a conventional male and female die.

The presently-preferred process thus alleviates the previously-noted inaccuracies introduced by movement of a workpiece during a bending process. Closer manufacturing tolerances can therefore be achieved in transformer-core windings formed from laminae bent in accordance with the presently-preferred process. Closer manufacturing tolerances, as previously noted, reduce the operating losses of the transformer core and therefore are highly desirable.

Moreover, the presently-preferred process facilitates bending the lamina 11 at multiple locations on a simultaneous basis. Simultaneous bending is possible because the portion of the lamina 11 located inward of the bending locations, i.e., the portion 11*a*, is securely clamped by the work table 12 and the male dies 21, 23. Hence, in contradistinction to a conventional bending process, only the portion of the lamina 11 located outward of the bending location deflects as the lamina 11 is displaced during the bending operation. This feature facilitates securing a middle portion of a lamina, and simultaneously bending portions of the lamina located outward of the middle portion. The ability to form multiple bends in a lamina on a simultaneous basis can substantially reduce the time and effort needed to manufacture a transformer-core winding comprising a plurality of such laminae.

The presently-preferred process does not induce substantial internal stresses within the lamina 11, provided the plastic deformation at the bending locations 28*a*, 28*b*, 30*a*, 30*b* is limited to approximately five times the thickness of the lamina 11. Furthermore, the preferred configuration of the male dies 21, 23 minimizes the stresses induced in the lamina 11 by the bending process. This concept is described in detail in co-pending U.S. patent application Ser. No. 09/711,284, filed on Nov. 13, 2000, which is incorporated by reference herein in its entirety. Hence, a transformer-core winding formed from laminae subject to the presently-preferred process does not require annealing to reduce operating losses, in contradistinction to a core formed conventionally from a continuous winding of magnetic material.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention to the full extent indicated by the broad general meaning of the terms in which the appended claims are expressed.

What is claimed is:

1. A process for bending a workpiece, comprising:

securing a desired bending location on the workpiece between an edge of a substantially flat surface and a tip of a v-shaped portion of a male die so that a portion of the workpiece overhangs the edge of the substantially flat surface and the workpiece is substantially restrained from linear movement in relation to the substantially flat surface; and causing the overhanging portion of the workpiece to pivot about the tip by urging a movable die along a substantially circular path independent of the substantially flat surface while the movable die contacts the overhanging portion of the workpiece.

2. The process of claim 1, wherein urging a movable die along a substantially circular path comprises moving a movable die having a substantially cylindrical shape along the substantially circular path.

3. The process of claim 1, wherein securing a desired bending location on the workpiece between a substantially flat surface and a tip of a v-shaped portion of a male die comprises bringing the tip into contact with the workpiece so that a predetermined contact pressure is established between the tip and the workpiece.

4. A process for bending a workpiece, comprising:

placing a first portion of the workpiece in contact with a substantially flat surface so that a second portion of the workpiece overhangs an edge of the substantially flat surface and a desired bending location on the workpiece is substantially aligned with the edge of the substantially flat surface;

securing the workpiece by urging a tip of a v-shaped portion of a male die onto the workpiece at the desired bending location so that so that the workpiece is substantially restrained from linear movement in relation to the substantially flat surface; and urging the second portion of the workpiece toward the male die.

5. The process of claim 4, wherein urging the second portion of the workpiece toward the male die comprises deflecting the second portion by applying a force to the second portion at a substantially constant location on the second portion.

6. The process of claim 5, wherein applying a force to the second portion at a substantially constant location on the second portion comprises applying the force at a location proximate the edge of the substantially flat surface.

7. The process of claim 5, wherein urging the second portion of the workpiece toward the male die comprises urging a substantially cylindrical bending die along a substantially circular path independent of the substantially flat surface while the substantially cylindrical die contacts the sect portion.

8. The process of claim 7, wherein urging a substantially cylindrical bending die along a substantially circular path comprises urging the substantially cylindrical bending die along the substantially circular path until the second portion is displaced by an angular increment of approximately 45 degrees.

9. A process for bending a workpiece, comprising:

placing a first portion of the workpiece on a substantially flat surface so that a second portion of the workpiece overhangs an edge of the substantially flat surface and a desired bending location on the workpiece is substantially aligned with the edge of the substantially flat surface;

securing the first portion of the workpiece on the substantially flat surface by clamping the desired bending location on the workpiece between the edge of the substantially flat surface and a substantially v-shaped end portion of a male die; and causing the second portion of the workpiece to pivot around a tip of the substantially v-shaped end portion by rotating a bending die around the tip independent of the substantially flat surface while the bending die contacts the second portion of the workpiece.

10. The process of claim 9, further comprising placing the bending die in contact with the second portion at a location on the second portion proximate the edge of the substantially flat surface.

11. The process of claim 9, wherein rotating a bending die around the tip comprises rotating a bending die having a substantially cylindrical shape around the tip.

12. The process of claim 9, wherein rotating a bending die around the tip comprises moving the bending die along a predetermined path having a substantially constant radius of curvature that intersects the tip.

13. The process of claim 9, wherein rotating a bending die around the tip independent of the substantially flat surface while the bending die contacts the second portion comprises rotating the bending die around the tip while the bending die contacts a substantially constant location on the second portion.

14. The process of claim 9, wherein causing the second portion of the workpiece to pivot about a tip of the substantially v-shaped end portion comprises causing the second portion of the workpiece to pivot about the tip until the second portion is displaced by an angular increment of approximately 45 degrees.

15. The process of claim 9, wherein securing the first portion of the workpiece on the substantially flat surface by clamping the desired bending location on the workpiece between the edge of the substantially flat surface and a substantially v-shaped end portion of a male die comprises bringing the tip of the substantially v-shaped end portion into contact with the workpiece so that the tip exerts a predetermined contact pressure on the workpiece.

16. The process of claim 9, further comprising:

placing the first portion of the workpiece in contact with a second substantially flat surface so that a third portion of the workpiece overhangs an edge of the second substantially flat surface and another desired bending location of the workpiece is substantially aligned with the edge of the substantially flat surface;

securing the first portion of the workpiece on the second substantially flat surface by clamping the another desired bending location on the workpiece between the second substantially flat surface and a substantially v-shaped end portion of a second male die; and causing the third portion of the workpiece to pivot a tip of the substantially v-shaped end portion of the second male die by rotating a second bending die around the tip of the substantially v-shaped end portion of the second male die independent of the substantially flat surface while the second bending die contacts the third portion.

17. A process for bending a workpiece at a desired bending location, comprising:

placing a portion of the workpiece on a substantially flat surface of a work table;

substantially aligning the desired bending location with an edge of the substantially flat surface;

clamping the workpiece between the substantially flat surface and a tip of a substantially v-shaped end portion of a male die substantially aligned with the edge of the substantially flat surface;

placing a substantially cylindrical bending die in contact with a location on the workpiece proximate the edge of the substantially flat surface; and rotating the bending die substantially around the tip while a point of contact between the workpiece and the bending die remains substantially constant.

18. A process for forming a transformer-core winding, comprising:

placing a first portion of a lamina formed from magnetic material on a substantially flat surface so that a second portion of the lamina overhangs an edge of the substantially flat surface and a desired bending location on the workpiece is substantially aligned with the edge of the substantially flat surface;

securing the first portion of the lamina on the substantially flat surface by clamping the desired bending location on the lamina between the edge of the substantially flat surface and a substantially v-shaped end portion of a male die;

causing the second portion of the lamina to pivot around a tip of the substantially v-shaped end portion by rotating a bending die around the tip independent of the substantially flat surface while the bending die contacts the second portion of the lamina;

removing the lamina from the substantially flat surface; and stacking the lamina with other lamina having a substantially similar shape.

19. A process for bending a workpiece at two locations thereon on a simultaneous basis, comprising:

placing a first portion of the workpiece on at least one of a first and a second substantially flat surface so that a second portion of the workpiece overhangs a first edge of the at least one of a first and a second substantially fiat surface and a first desired bending location on the workpiece is substantially aligned with the first edge and a third portion of the workpiece overhangs a second edge of the at least one of a first and a second substantially flat surface and a second desired bending location on the workpiece is substantially aligned with the second edge;

securing the first portion of the workpiece on the at least one of a first and a second substantially flat surface by damping the workpiece between the at least one of a first and a second substantially flat surface and a substantially v-shaped end portion of a first male die at the first desired bending location, and between the at least one of a first and a second substantially flat surface and a substantially v-shaped end portion of a second male die at the second desired bending location; and causing the second portion of the workpiece to pivot about a tip of the substantially v-shaped end portion of the first male die by rotating a first bending die around the tip of the substantially v-shaped end portion of the first male die while the first bending die contacts the second portion of the workpiece, and simultaneously causing the third portion of the workpiece to pivot about a tip of the substantially v-shaped end portion of the second male die by rotating a second bending die around the tip of the substantially v-shaped end portion of the second male die while the second bending die contacts the third portion of the workpiece.

20. The process of claim 19, wherein causing the second portion of the workpiece to pivot about a tip of the substantially v-shaped end portion of the first male die comprises causing the second portion to pivot about the tip of the substantially v-shaped end portion of the first male die until the second portion is displaced by an angular increment of approximately 45 degrees, and causing the third portion of the workpiece to pivot about a tip of the substantially v-shaped end portion of the second male die comprises causing the third portion of the workpiece to pivot about the tip of the substantially v-shaped end portion of the second male die until the third portion is displaced by an angular increment of approximately 45degrees.

21. The process of claim 19, further comprising:

subsequently moving the at least one of a first and the second substantially flat surface so that a third location on the workpiece is substantially aligned with the first edge and a fourth location on the workpiece is substantially aligned with the second edge;

securing a portion of the workpiece located inward of the third and fourth locations on the at least one substantially flat surface by clamping the workpiece between the at least one of a first and a second substantially flat surface and the substantially v-shaped end portion of the first male die, and between the at least one of a first and a second substantially flat surface and the substantially v-shaped end portion of the second male die; and causing a portion of the workpiece located outward of the third location to pivot about the tip of the substantially v-shaped end portion of the first male die by rotating the first bending die around the tip of the substantially v-shaped end portion of the first male die while the first bending die contacts the portion of the workpiece located outward of the third location, and simultaneously causing the portion of the workpiece located outward of the fourth location to pivot about the tip of the substantially v-shaped end portion of the second male die by rotating the second bending die around the tip of the substantially v-shaped end portion of the second male die while the second bending die contacts the portion of the workpiece located outward of the fourth location.

22. The process of claim 19, further comprising adjusting a distance between the first and the second edges so that the distance between the first and the second edges is approximately equal to the distance between the two locations on the workpiece.

23. The process of claim 22, wherein adjusting a distance between the first and the second edges so that the distance between the first and the second edges is approximately equal to the distance between the two locations on the workpiece comprises moving a second half of a work table comprising the first substantially flat surface in relation to a first half of the work table comprising the second substantially flat surface.

24. A process for bending a workpiece at two locations thereon on a simultaneous basis, comprising:

placing a first portion of the workpiece on at least one of a first and a second substantially flat surface so that a second portion of the workpiece overhangs a first edge of the at least one of a first and a second substantially flat surface and a third portion of the workpiece overhangs a second edge of the at least one of a first and a second substantially flat surface;

securing the first portion of the workpiece on the at least one of a first and a second substantially flat surface by clamping the workpiece between the at least one of a first and a second substantially flat surface and a substantially v-shaped end portion of a first male die, and between the at least one of a first and a second substantially flat surface and a substantially v-shaped end portion of a second male die;

causing the second portion of the workpiece to pivot about a tip of the substantially v-shaped end portion of the first male die by rotating a first bending die around the tip of the substantially v-shaped end portion of the first male die while the first bending die contacts the second portion of the workpiece, and simultaneously causing the third portion of the workpiece to pivot about a tip of the substantially v-shaped end portion of the second male die by rotating a second bending die around the tip of the substantially v-shaped end portion of the second male die while the second bending die contacts the third portion of the workpiece;

subsequently moving the at least one of a first and the second substantially flat surface so that a third location on the workpiece is substantially aligned with the first edge and a fourth location on the workpiece is substantially aligned with the second edge;

securing a portion of the workpiece located inward of the third and fourth locations on the at least one of a first and a second substantially flat surface by clamping the workpiece between the at least one of a first and a second substantially flat surface and the substantially v-shaped end portion of the first male die, and between the at least one of a first and a second substantially flat surface and the substantially v-shaped end portion of the second male die; and causing a portion of the workpiece located outward of the third location to pivot about the tip of the substantially v-shaped end portion of the first male die by rotating the first bending die around the tip of the substantially v-shaped end portion of the first male die while the first bending die contacts the portion of the workpiece located outward of the third location, and simultaneously causing the portion of the workpiece located outward of the fourth location to pivot about the tip of the substantially v-shaped end portion of the second male die by rotating the second bending die around the tip of the substantially v-shaped end portion of the second male die while the second bending die contacts the portion of the workpiece located outward of the fourth location.

* * * * *